US011261581B2

(12) United States Patent
Misaki

(10) Patent No.: US 11,261,581 B2
(45) Date of Patent: Mar. 1, 2022

(54) SHOVEL

(71) Applicant: SUMITOMO(S.H.I.) CONSTRUCTION MACHINERY CO., LTD., Tokyo (JP)

(72) Inventor: Youji Misaki, Chiba (JP)

(73) Assignee: SUMITOMO(S.H.I.) CONSTRUCTION MACHINERY CO., LTD., Tokyo (JP)

( * ) Notice: Subject to any disclaimer, the term of this patent is extended or adjusted under 35 U.S.C. 154(b) by 191 days.

(21) Appl. No.: 15/705,381

(22) Filed: Sep. 15, 2017

(65) Prior Publication Data

US 2018/0002895 A1 Jan. 4, 2018

Related U.S. Application Data

(63) Continuation of application No. PCT/JP2016/058437, filed on Mar. 17, 2016.

(30) Foreign Application Priority Data

Mar. 20, 2015 (JP) ..... JP2015-058709

(51) Int. Cl.
*E02F 9/20* (2006.01)
*F02D 29/00* (2006.01)
(Continued)

(52) U.S. Cl.
CPC ..... *E02F 9/2066* (2013.01); *E02F 3/32* (2013.01); *E02F 9/20* (2013.01); *E02F 9/2004* (2013.01);
(Continued)

(58) Field of Classification Search
CPC ..... E02F 9/2066
(Continued)

(56) References Cited

U.S. PATENT DOCUMENTS 3,805,640 A * 4/1974 Schneider ..... B60W 10/06 477/56
5,002,454 A * 3/1991 Hadank ..... E02F 3/437 180/333
(Continued)

FOREIGN PATENT DOCUMENTS

DE 4222990 A1 * 10/1993
GB 2184162 6/1987
(Continued)

OTHER PUBLICATIONS

English Translation of Japanese Patent Application Pub. No. JP 2011-149236 A to Tadao et al. that was filed in 2010 and published in 2011 (downloaded on Jun. 3, 2019).*
(Continued)

*Primary Examiner* — Jean Paul Cass
(74) *Attorney, Agent, or Firm* — IPUSA, PLLC

(57) ABSTRACT

A shovel enabled to set an engine revolution speed to revolution speeds including a revolution speed for a running operation and a revolution speed for an idling running operation that is lower than the revolution speed for the running operation includes an engine provided as a driving source of the shovel, an operating part configured to be driven by a driving force of the engine, an operation component configured to operate the operating part, a detecting device configured to detect a position of a movable portion of an operator and a position of the operation component, an operation determining part configured to determine a positional relationship between the movable portion and the operation component, and a control part configured to set the engine revolution speed of the engine based on the positional relationship between the movable portion and the operation component that is determined by the operation determining part.

7 Claims, 8 Drawing Sheets

(51) Int. Cl.
*F02D 45/00* (2006.01)
*E02F 3/32* (2006.01)
*F02D 31/00* (2006.01)

(52) U.S. Cl.
CPC ..... *F02D 29/00* (2013.01); *F02D 31/001* (2013.01); *F02D 45/00* (2013.01)

(58) Field of Classification Search
USPC ..... 701/50
See application file for complete search history.

(56) References Cited

U.S. PATENT DOCUMENTS 5,160,239 A * 11/1992 Allen ..... E02F 3/437 172/4.5
5,232,057 A * 8/1993 Renard ..... E02F 9/2004 137/636.2
5,265,995 A * 11/1993 Beck ..... E02F 3/964 180/331
5,424,623 A * 6/1995 Allen ..... B25J 9/162 180/324
5,446,980 A * 9/1995 Rocke ..... E02F 3/439 37/348
7,489,303 B1 * 2/2009 Pryor ..... B60K 35/00 345/173
8,068,942 B2 * 11/2011 Breed ..... G02B 27/01 701/1
9,164,596 B1 * 10/2015 Lee ..... G06K 9/00335
10,235,412 B2 * 3/2019 Underkoffler ..... G06F 40/205
2002/0158518 A1 10/2002 Taylor et al.
2008/0103613 A1 5/2008 Vanhelle et al.
2008/0211779 A1 * 9/2008 Pryor ..... G06F 3/04847 345/173
2010/0182017 A1 * 7/2010 Reddy ..... B60K 26/04 324/662
2011/0153171 A1 * 6/2011 Krause ..... E02F 3/844 701/50
2014/0373666 A1 * 12/2014 Gulati ..... G05G 9/047 74/504
2015/0314684 A1 * 11/2015 Kronberg ..... B60K 28/02 340/439
2015/0346834 A1 * 12/2015 Martinez Fernandez ..... G06F 3/017 340/12.5
2016/0257198 A1 * 9/2016 Buttolo ..... B60K 35/00
2016/0357262 A1 * 12/2016 Ansari ..... G06Q 10/0833
2017/0112671 A1 * 4/2017 Goldstein ..... H04R 1/1083
2017/0161016 A1 * 6/2017 McDunn ..... G06F 3/167
2017/0269599 A1 * 9/2017 Ansari ..... G05D 1/0212
2017/0282717 A1 * 10/2017 Jang ..... G06F 3/04817
2017/0312614 A1 * 11/2017 Tran ..... A61B 5/11
2017/0318360 A1 * 11/2017 Tran ..... B33Y 80/00
2018/0288586 A1 * 10/2018 Tran ..... A63B 69/36
2019/0092169 A1 * 3/2019 Thurimella ..... B60K 35/00

FOREIGN PATENT DOCUMENTS

JP H07-011985 1/1995
JP 2002-364402 12/2002
JP 2011-149236 8/2011
JP 2013-076381 4/2013
KR 20210040982 A * 4/2021 ..... G06K 9/00389

OTHER PUBLICATIONS

Google translation of German Patent Pub. No. DE4222990A1 to Koller that was published in 1993 (hereinafter "Koller").*
International Search Report for PCT/JP2016/058437 dated May 31, 2016.

* cited by examiner

SHOVEL

CROSS-REFERENCE TO RELATED APPLICATIONS

This application is a continuation application filed under 35 U.S.C. 111(a) claiming the benefit under 35 U.S.C. 120 and 365(c) of a PCT International Application No. PCT/JP2016/058437 filed on Mar. 17, 2016, which is based upon and claims the benefit of priority of the prior Japanese Patent Application No. 2015-058709 filed on Mar. 20, 2015, the entire contents of which are incorporated herein by reference.

BACKGROUND OF THE INVENTION

1. Field of the Invention

The present invention generally relates to a shovel, in which a target set revolution speed of an engine can be changed.

2. Description of the Related Art

There is a shovel having an auto idling function, by which the revolution speed of an engine is automatically decreased (switching to an idling running operation) when a no-operation state continues in the construction machine.

Switching to the idling running operation in the auto idling function is determined whether the no-operation state continues for a predetermined time. Determination of whether the shovel is in the no-operation state can be done using a mechanical switch or a sensor. For example, it is possible to determine the no-operation state, for example, in a case where the position of an operation lever is detected by a sensor and the operation lever is at an operated position (a fallen position). Alternatively, the pilot pressure generated in response to the operation of the operation lever is detected to know the no-operation state.

SUMMARY OF THE INVENTION

In the auto idling function, while the engine is performing an idling running operation, an operation lever is determined to be operated, and thereafter a control of increasing the engine revolution speed to a revolution speed for an ordinary running operation is performed. However, the engine revolution speed does not instantaneously increase, and a certain time duration is required for the engine revolution speed to reaches a revolution speed necessary for driving. Therefore, there may be a drawback that the shovel is not operated to perform an ordinary speed and power until the engine revolution speed becomes the ordinary revolution speed for the running operation.

An object of the embodiment of the present invention is to provide a shovel that can determine whether there exists an operation to operation components before the operation components are operated to rapidly control the engine revolution speed.

According to the embodiment, there is provided a shovel enabled to set an engine revolution speed to a plurality of revolution speeds including a revolution speed for a running operation and a revolution speed for an idling running operation that is lower than the revolution speed for the running operation includes an engine provided as a driving source of the shovel, an operating part configured to be driven by a driving force of the engine, an operation component configured to operate the operating part, a detecting device configured to detect a position of a movable portion of an operator and a position of the operation component, an operation determining part configured to determine a positional relationship between the movable portion of the operator and the operation component, and a control part configured to set the engine revolution speed of the engine based on the positional relationship between the movable portion of the operator and the operation component that is determined by the operation determining part.

According to the embodiment of the present invention, it is possible to previously determine whether the operation components are operated based on a captured image of the operation components to rapidly control the engine revolution speed.

DETAILED DESCRIPTION OF EMBODIMENTS

Embodiments of the present invention are described with reference to figures.

Figure 1:
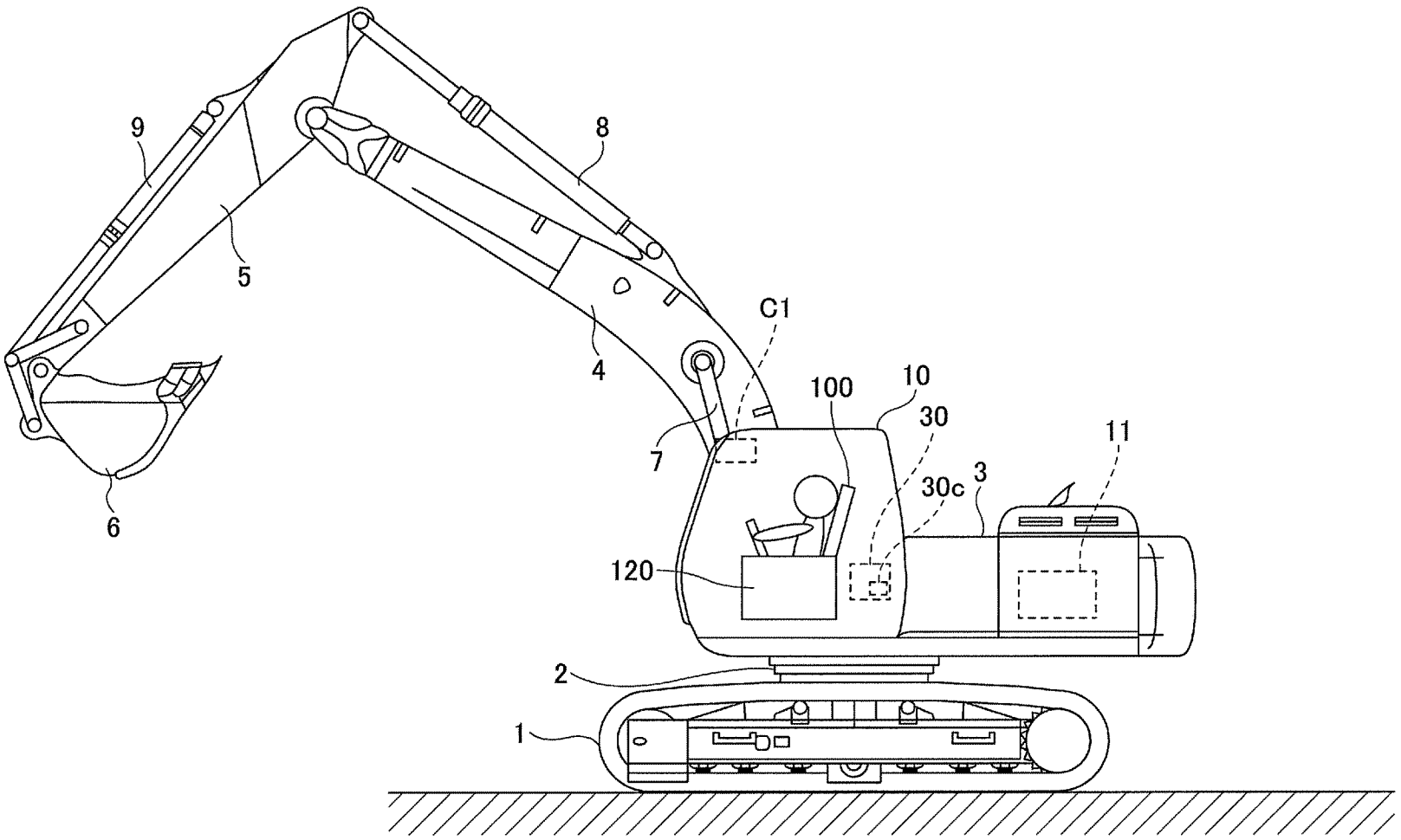
FIG. 1 is a side view of a shovel of an embodiment of the present invention.

FIG. 1 is a side view of the shovel of the embodiment. In the shovel, an upper-part swiveling body 3 is installed in a lower-part traveling body 1 through a swivel mechanism 2 so as to be rotatable relative to the lower-part traveling body 1. A boom 4 is attached to the upper-part swiveling body 3. An arm 5 is attached to a tip end of the boom 4. A bucket 6 as an end attachment is attached to the tip end of the arm 5.

The boom 4, the arm 5, and the bucket 6 form a drilling attachment as an example of the attachment. The boom 4, the arm 5, and the bucket 6 are hydraulically driven by a boom cylinder 7, an arm cylinder 8, and a bucket cylinder 9, respectively.

A cabin 10 as a driver's cabin is installed in the upper-part swiveling body 3. An engine 11 as a power source of the shovel is installed on a back side of the cabin 10 of the upper-part swiveling body 3. The engine 11 is an internal combustion engine such as a diesel engine.

A console 120 provided with a driver's seat 100 and an operation lever is installed inside the cabin 10. Further, a controller 30 and a camera C1 are installed inside the cabin 10.

The controller 30 is a control device for performing a drive control of the shovel. Within the embodiment, the controller 30 is formed by an arithmetic processing device including a central processing unit (CPU) and a memory 30*c*. Various functions of the controller 30 are implemented when the CPU executes a program stored in the memory 30*c*. An engine revolution speed control described below is done by the controller 30.

The camera C1 in installed on an upper side of the console 120, captures an image of the operation lever and the vicinity of the operation lever, and supplies image information including the captured image to the controller 30. The controller 30 recognizes the operation lever and a hand of an operator in the image information obtained from the camera C1, and presumes or determines the operation if the operation lever from a recognized result.

Figure 2:
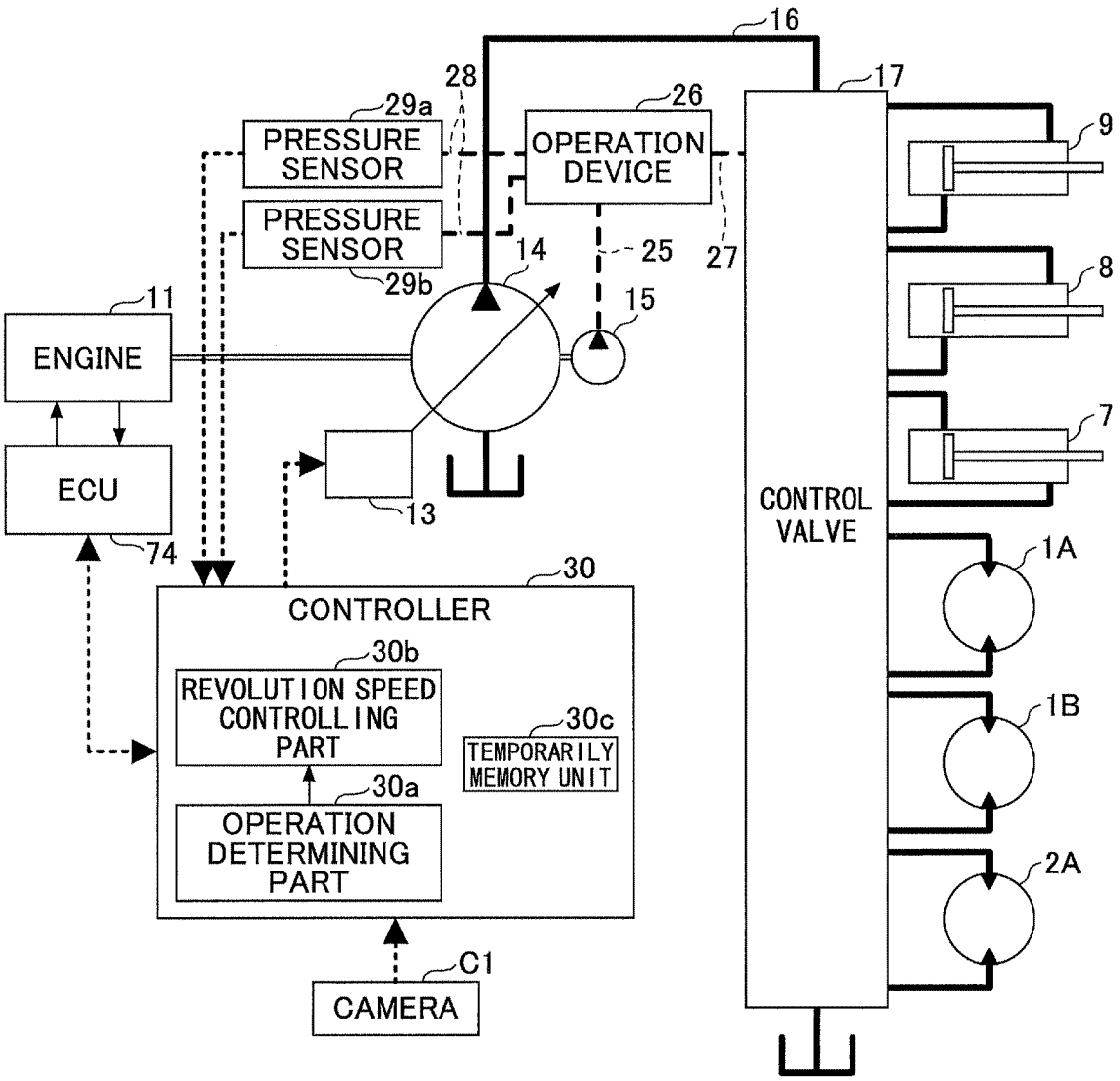
FIG. 2 is a block diagram illustrating a structure of a drive system of the shovel illustrated in FIG. 1.

FIG. 2 is a block diagram illustrating the structure of a drive system of the shovel illustrated in FIG. 1. Referring to FIG. 2, a mechanical power system is indicated by a double line, a high-pressure hydraulic line is indicated by a heavy solid line, a pilot line is indicated by a heavy broken line, and an electrical drive and control system is indicated by a dotted line.

The drive system of the shovel includes the engine 11, a regulator 13, a main pump 14, a pilot pump 15, a control valve 17, an operation device 26, pressure sensors 29*a* and 29*b*, and the controller 30.

The engine 11 is driven and controlled by an engine control unit (ECU) 74. The engine 11 is a driving source of the shovel. An output shaft of the engine 11 is connected to an input shaft of the main pump 14 and an input shaft of the pilot pump 15. The main pump 14 and the pilot pump 15 are driven by power force of the engine 11 so as to generate hydraulic pressure.

The main pump 14 supplies a high-pressure operating oil to the control valve 17 through the high-pressure hydraulic line 16. This main pump 14 may be a swash plate type variable displacement hydraulic pump.

The regulator 13 is a device for controlling a discharge quantity from the main pump 14. The regulator 13 adjusts a swash plate inclination angle of the main pump 14 in response to a discharge pressure of the main pump 14, a control signal from the controller 30, or the like. Said differently, the discharge quantity of the operating oil from the main pump 14 is controlled by the regulator 13.

The pilot pump 15 supplies the operating oil to various hydraulic pressure controlling apparatuses through a pilot line 25. The pilot pump 15 may be, for example, a fixed displacement type hydraulic pump.

The control valve 17 is a hydraulic pressure control device that controls a hydraulic system of the shovel. The control valve 17 selectively supplies the operating oil discharged from the main pump 14 to the boom cylinder 7, the arm cylinder 8, the bucket cylinder 9, a left side hydraulic traveling motor 1A, a right side hydraulic traveling motor 1B, and a hydraulic swiveling motor 2A.

The operation device 26 is used to operate various hydraulic actuator including various cylinders 7 to 9, hydraulic traveling motors 1A and 1B, and various hydraulic actuators including the hydraulic swiveling motor 2A. Within the embodiment, the operation device 26 includes a right and left pair of levers 26A and 26B (the operation components) for moving the boom 4 up and down, opening and closing the bucket 6, and operating swiveling of the upper-part swiveling body 3 and a pair of pedals 26C and 26D (the operation components) for operating traveling of the lower-part traveling body 1. The operation device 26 is connected to the control valve 17 through a hydraulic line 27.

The operation device 26 is connected to pressure sensors 29*a* and 29*b* through a hydraulic line 28. The pressure sensors 29*a* and 29*b* detect an operation content of operating the operation device 26 in a form of pressure, and a detected value is output to the controller 30. A sensor other than an inclination sensor for detecting inclination of various operation devices and a pressure sensor may be used to detect the operation content of the operation device 26.

The controller 30 is a control device for controlling the shovel. Within the embodiment, the controller 30 is formed by a computer including a central processing unit (CPU), a random access memory (RAM), a read only memory (ROM). Further, the controller 30 reads a program corresponding to various functional elements from the ROM, loads the read program onto the RAM, and causes processes corresponding to the various functional elements to be executed by the CPU.

Further, the controller 30 detects the operation contents (e.g., an existence of a lever operation, a direction of operating a lever, a lever operation quantity, or the like) of the operation device 26 based on the outputs from the pressure sensors 29*a* and 29*b*. Further, the controller 30 processes a revolution speed control of the engine 11 based on the image information obtained from the camera C1 or the like. As illustrated in FIG. 2, the controller 30 includes an operation determining part 30*a* and a revolution speed controlling part 30*b* as a functioning unit in order to achieve this revolution speed control process. The processes performed by the operation determining part 30*a* and the revolution speed controlling part 30*b* are described later. The operation determining part 30*a* is not necessarily implemented by the controller 30 and may be implemented by another controller different from the controller 30.

Figure 3:
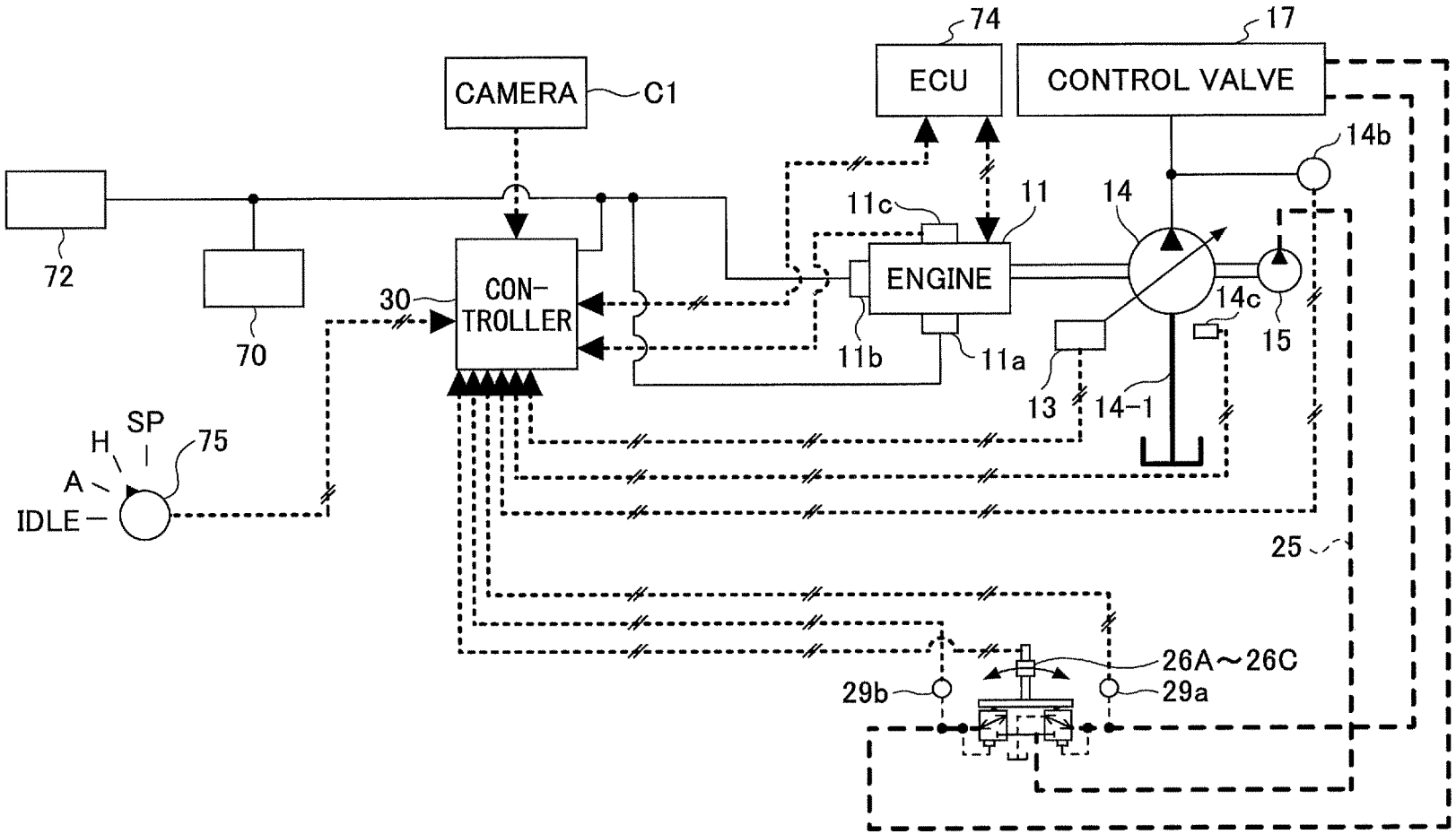
FIG. 3 illustrates a structure of a control system of an engine mounted on the shovel illustrated in FIG. 1.

FIG. 3 illustrates a structure of an electric control system of the shovel illustrated in FIG. 1.

As described, the engine 11 is controlled by the ECU 74. Various data indicating the state of the engine 11 are always sent to the controller 30. The controller 30 accumulates these various data in the temporarily memory unit (a memory) 30*c*.

Data of a coolant temperature is supplied from a water temperature sensor 11*c* provided in the engine 11 to the controller 30. A command value of a swash plate angle is supplied from the controller 30 to the regulator 13 of the main pump 14. Data indicating a discharge pressure of the main pump 14 are supplied to the controller 30 from the pressure sensor 14*b*.

An oil temperature sensor 14*c* is installed in a pipe line 14-1 between a tank storing an operating oil sucked by the main pump 14 and the main pump 14. Temperature data of the operating oil flowing inside the pipe line 14-1 are supplied to the controller 30 from the oil temperature sensor 14*c*.

The operation device 26 includes pressure sensors 29*a* and 29*b*. A pilot pressure sent to the control valve 17 at a time of operating the operation levers 26A and 26Bvis detected by the pressure sensors 29*a* and 29*b*. Data indicating the pilot pressure detected by the pressure sensors 29*a* and 29 are supplied to the controller 30.

Further, the shovel according to the embodiment includes an engine revolution speed adjusting dial 75 provided inside the cabin 10. The engine revolution speed adjusting dial 75 adjusts the revolution speed of the engine.

Specifically, the engine revolution speed adjusting dial 75 is configured to switch the engine revolution speed to multiple stages of four or greater stages including an SP mode, an H mode, an A mode, and an idling mode. Data indicating a setup state of the engine revolution speed adjusting dial 75 are always supplied to the controller 30.

The SP mode is the revolution speed mode selected in a case where priority is given to a work rate, and uses the highest engine revolution speed (the revolution speed for the running operation). The H mode is the revolution speed mode selected in a case where both of the work rate and the fuel consumption are satisfied, and uses the second highest engine revolution speed (the revolution speed for the running operation). The A mode is the revolution speed mode selected in a case where the shovel runs with a low noise while priority is given to the fuel consumption are satisfied, and uses the third highest engine revolution speed (the revolution speed for the running operation). The idling mode is the revolution speed mode selected in a case where the engine is in an idling state, and uses the lowest engine revolution speed (the revolution speed for the running operation). The revolution speed of the engine 11 is constantly controlled to be the engine revolution speed for the revolution speed mode set by the engine revolution speed adjusting dial 75. If a predetermined condition is satisfied as described later, a command value of a set engine revolution speed is output to change the engine revolution speed.

Figure 4:
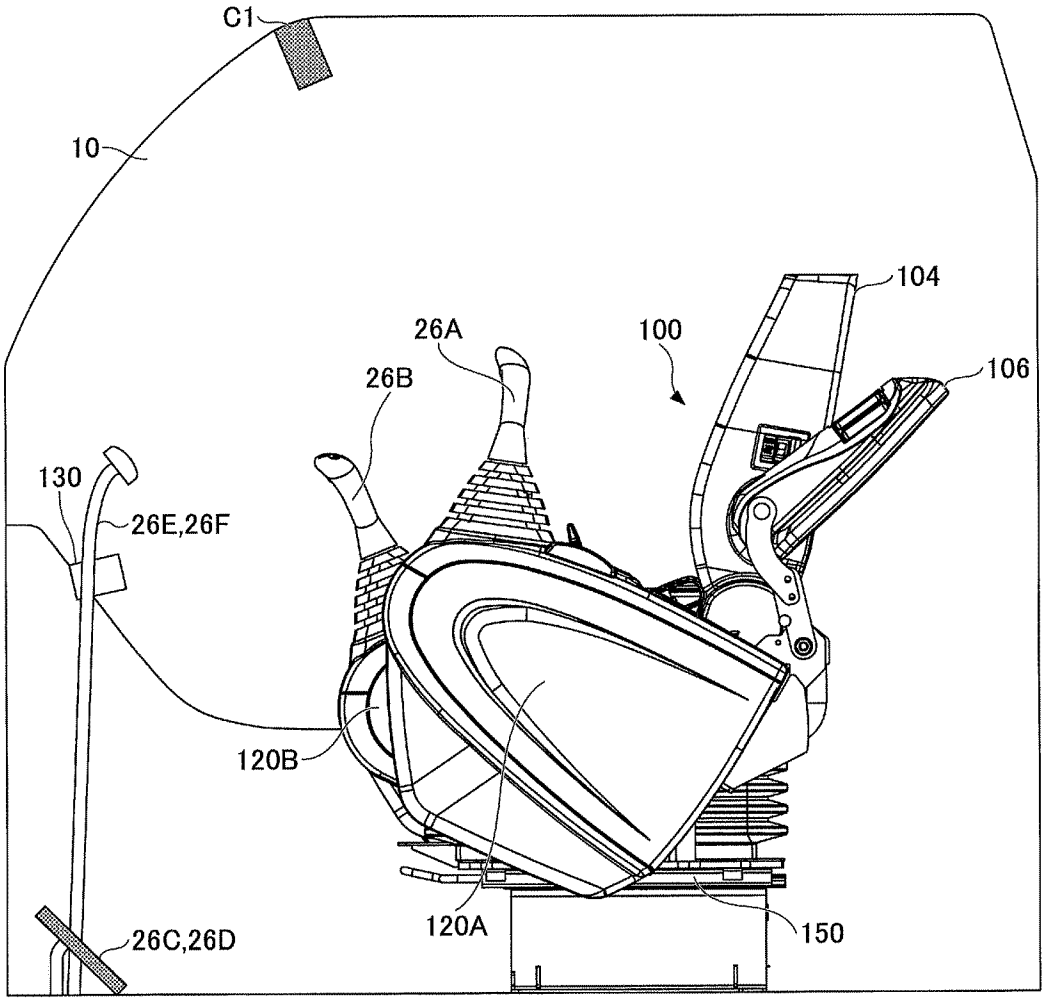
FIG. 4 is a side view of a driver's seat and a console provided inside the cabin.
Figure 5:
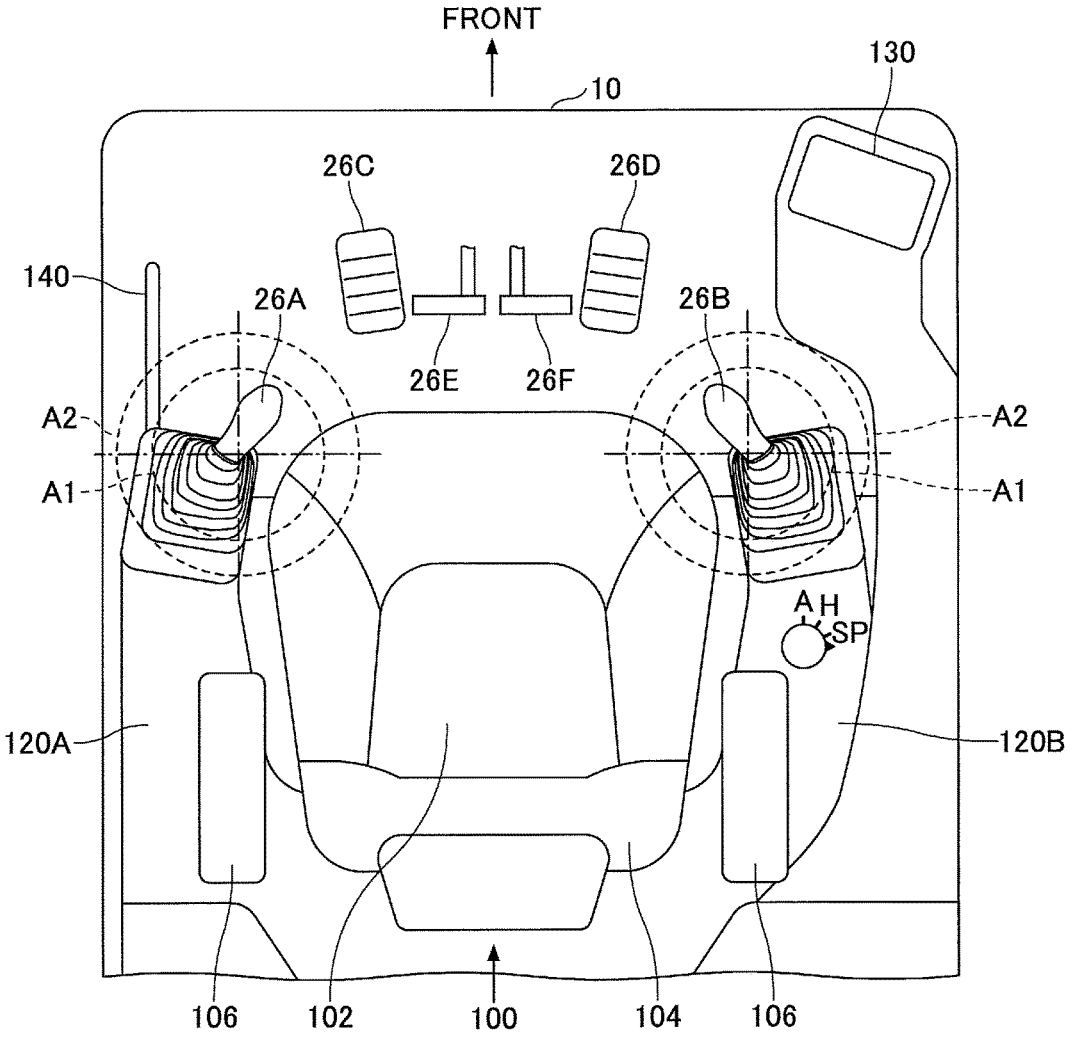
FIG. 5 is a plan view of the driver's seat and the console provided inside the cabin.

Next, referring to FIGS. 4 and 5, the driver's seat 100 and the operation device 26, which are installed inside the cabin 10, are described. FIG. 4 is a side view of the cabin 10, in which a left side of the inside of the cabin 10 is rotated. FIG. 5 is a plan view of the cabin in which the driver's seat 100 and the periphery of the driver's seat 100 are viewed from above.

The driver's seat 100 is installed inside the cabin 10. The driver's seat 100 includes a seat on which an operator 100 sits and a backrest 104. The driver's seat is a reclining seat, in which the reclining angle of the backrest 104 can be adjusted. Armrests 106 are disposed on both left and right sides of the driver's seat 100. The armrests 106 are supported by the driver's seat 100 so as to be rotatable. When the operator of the shovel leaves the driver's seat 100, the armrest 106 is backward rotated as illustrated in FIG. 4 so as not to cause an obstruction.

A console 120A and a console 120B are respectively arranged on both left and right sides of the driver's seat 100. The driver's seat 100 and the consoles 120A and 120*b* are supported by a rail 150 fixed onto a floor surface of the cabin 10 so as to be movable on the rail 150. The operator can move the driver's seat 100 and the consoles 120A and 120B to a preferred position relative to the operation levers 26E and 26F and a front windshield and fix the driver's seat 100 and the consoles 120A and 120B to the preferred position. Further, only the driver's seat can be slid forward or backward to adjust the position of the driver's seat relative to the positions of the consoles 120A and 120B.

The operation lever 26A is disposed on a front side of the left console 120A. The operation lever 26B is disposed on a front side of the right console 120B. The operator sitting down in the driver's seat 100 grabs the operation lever 26A with the left hand of the operator to operate the operation lever 26A and grabs the operation lever 26B with the right hand of the operator to operate the operation lever 26B. Each of the consoles 120A and 120B is supported so as to be rotatable. The operator can adjust the angles of the consoles 120A and 120B to adjust the angles of the operation levers 26A and 26B at their neutral positions.

Operation pedals 26C and 26D are disposed on the floor surface on a front side of the driver's seat 100. The operator sitting down on the driver's seat 100 operates the operation pedal 26C with his or her left foot to drive the left side hydraulic traveling motor 1A. The operator sitting down on the driver's seat 100 operates the operation pedal 26D with his or her right foot to drive the right side hydraulic traveling motor 1B.

An operation lever 26E upwards extends from a vicinity of the operation pedal 26C. The operator sitting down on the driver's seat 100 grabs the operation lever 26E with his or her left hand to operate the operation lever 26E. Thus, in a manner similar to the operation using the operation pedal 26C, the hydraulic traveling motor 1A can be driven. An operation lever 26F upwards extends from a vicinity of the operation pedal 26D. The operator sitting down on the driver's seat 100 grabs the operation lever 26F with his or her right hand to operate the operation lever 26F. Thus, in a manner similar to the operation using the operation pedal 26D, the hydraulic traveling motor 1B can be driven.

A monitor 130 displaying information such as a work condition and a running state of the shovel is disposed at a right front part inside the cabin 10. The operator sitting down on the driver's seat 100 can do the work using the shovel while checking various information displayed on the monitor 130.

A gate lock lever 140 is provided on the left side (said differently, a side of an entrance door in the cabin) of the driver's seat 100. By pulling up the gate lock lever 140, the engine 11 is permitted to start and the shovel can be operated. By pulling down the gate lock lever 140, an operating part including the engine 11 cannot start up. Therefore, without a state where the operator sits down on the driver's seat and pulls up the gate lock lever 140, the shovel cannot be operated to secure the safety.

Within the embodiment, the camera C1 is attached above the driver's seat inside the cabin 10. The camera C1 is disposed at a position from which images of the operation levers 26A, 26B, 26E, and 26F and the operation pedals 26C and 26D can be captured.

The camera C1 may be an image capturing device such as a video camera capturing a motion picture or an image capturing device of continuously capturing images at a constant short time interval. The image captured by the camera C1 is sent to the controller 30 and is used for an engine revolution speed control process described below.

The engine revolution speed control process of the embodiment is to control the revolution speed of the engine based on a determination whether the hand or the foot (a movable part of the operator) of the operator is in a state where the operation components such as the operation lever or the operation pedal are ready for the operation.

Figure 6:
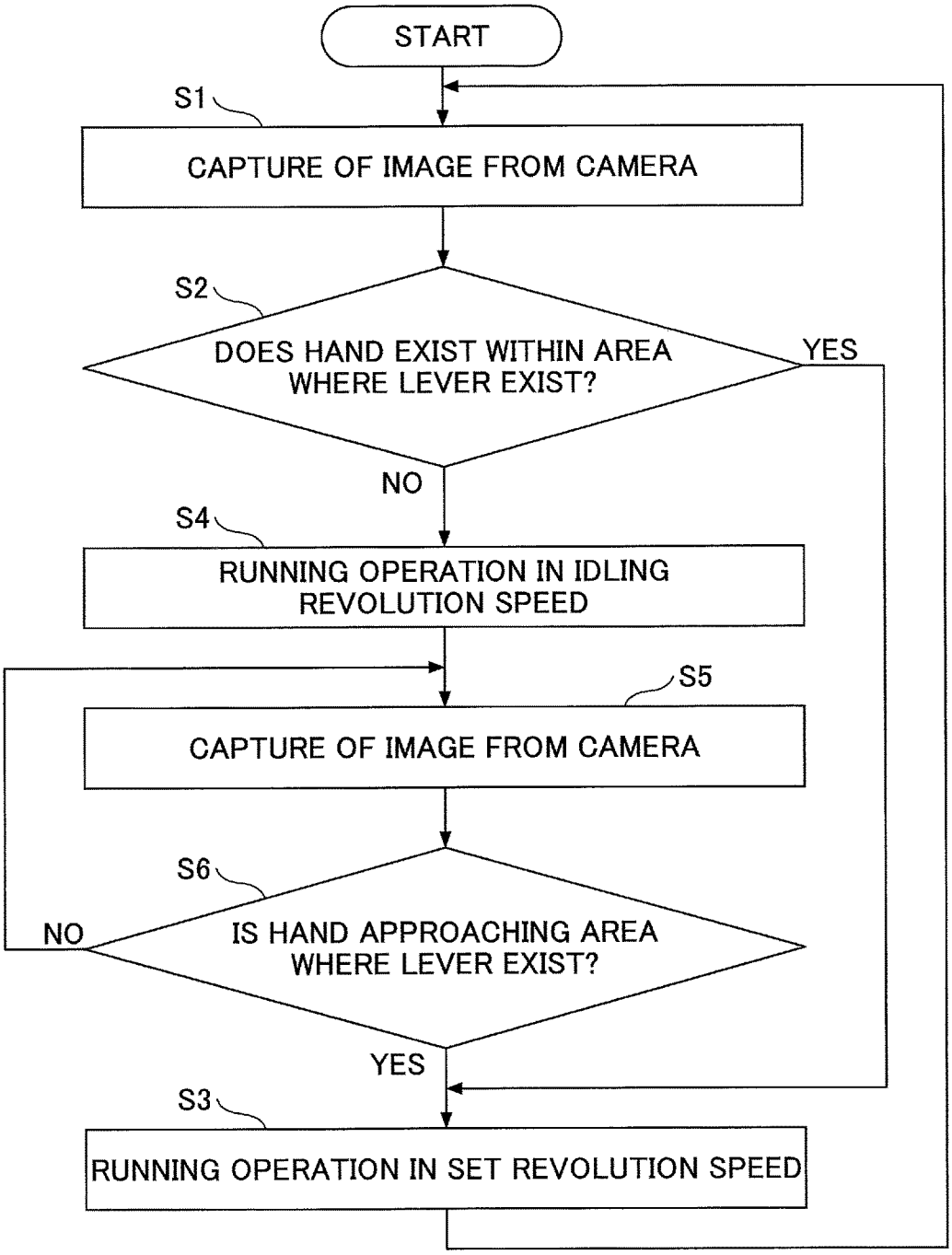
FIG. 6 is a flow chart illustrating a control process of controlling an engine revolution speed.

FIG. 6 is a flowchart of the engine revolution speed control process. The engine revolution speed control process is a process performed when the controller 30 executes a program. The operation determining part 30*a* (see FIG. 2) being a functioning unit of the controller 30 performs a determination of whether the hand or the foot (the movable part of the operator) of the operator is in the state where the operation components such as the operation lever or the operation pedal are ready for the operation based on the image information from the camera C1. The revolution speed controlling part 30*b* (see FIG. 2) being the functioning unit of the controller 30 sends a command to the ECU 74 so as to set the revolution speed of the engine 11 to be a predetermined revolution speed based on a result of the determination obtained by the operation determining part 30*a*.

After the engine revolution speed control process illustrated in FIG. 6 is started, the operation determining part 30*a* captures the image information from the camera C1 (step S1).

The operation determining part 30*a* recognizes, for example, the operation lever 26A and the hand of the operator, from the captured image information, and determines whether the hand of the operator is included in a predetermined area which includes the operation lever 26A (step S2). Specifically, the operation determining part 30*a* determines whether a part of the hand of the operator is included in the area (for example, an area inside a circle A1 of a dotted line in FIG. 5) specified by a predetermined radius from, for example, a center of the operation lever 26A in the captured image information. Alternatively, the operation determining part 30*a* may recognizes an outer shape of the operation lever 26A and an outer shape of the operator from image information and may determine whether the outer shape of the hand touches the outer shape of the operation lever 26A.

In step S2, if the operation determining part 30*a* determines in step S2 that the hand of the operator is included inside the predetermined area including the operation lever 26A (YES in step S2), then the process goes to step S3. In step S3, the revolution speed controlling part 30*b* of the controller 30 sets the revolution speed of the engine 11 to be the revolution speed for the ordinary running operation based on the determination in the operation determining part 30*a*. For example, if the revolution speed of the engine 11 is set to the revolution speed for the ordinary running operation, the revolution speed controlling part 30*b* sends a command to the ECU 74 so as to maintain the set revolution speed. In step S2, it may be determined to go to step S3 only when right and left hands are respectively included in the predetermined areas of right and left operation levers.

Said differently, in a case where the hand of the operator is included inside the predetermined area including the operation lever 26A, the controller 30 determines that the operator operates or is to operate the operation lever 26A and causes the revolution speed of the engine 11 to be the revolution speed of the engine 11 for the ordinary running operation. Therefore, for example, when the operator is checking the periphery or the work progress while the operator keeps the operation lever 26 at the neutral position, the revolution speed of the engine 11 is kept to be the revolution speed of the engine 11 for the work. Accordingly, if the operator immediately operates the operation lever 26A, it is unnecessary to recover the engine revolution speed from the revolution speed for the idle run to the revolution speed for the work and the work can be rapidly reopened.

Figure 7:
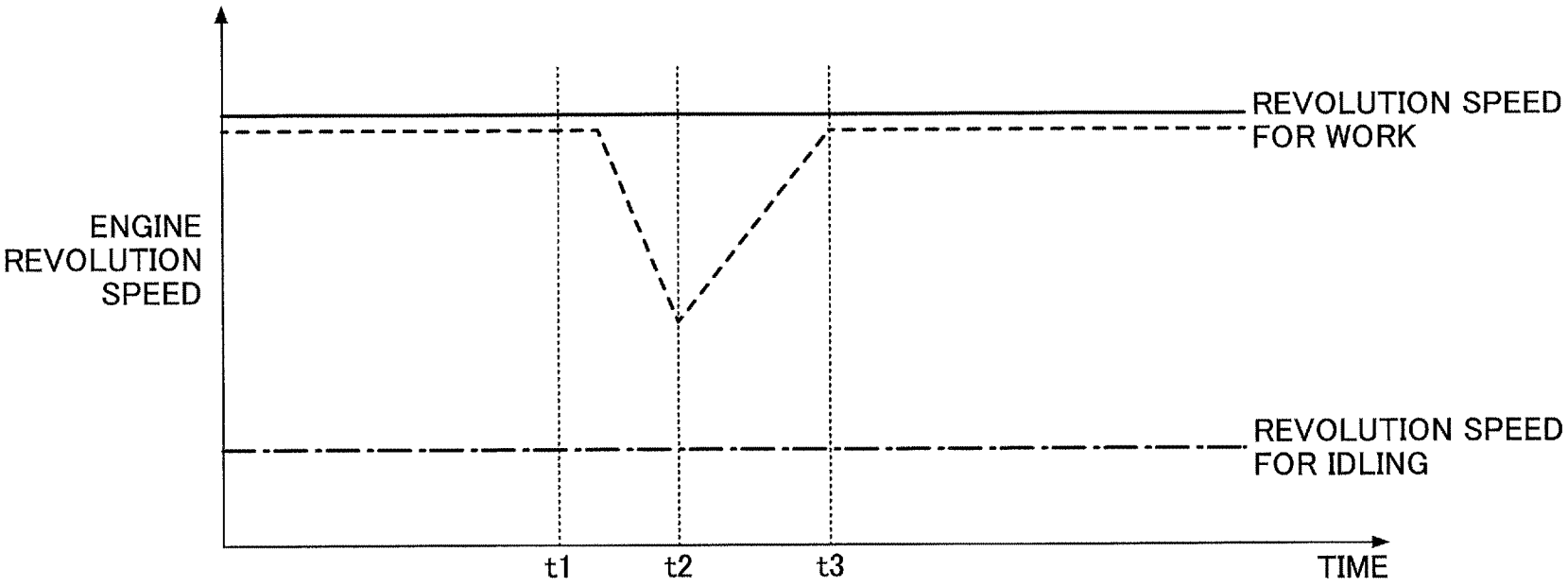
FIG. 7 is a time chart illustrating a change in an engine revolution speed in a case where an operation is done after an operation lever is returned to a neutral position.

FIG. 7 is a time chart illustrating a change in the engine revolution speed in a case where the above engine revolution speed control process is done. Referring to FIG. 7, a transition of the engine revolution speed is illustrated using the solid line in a case where an operation of the operation lever 26A by the operator is temporarily stopped for a short time period while the above engine revolution speed control process is being performed. Referring to FIG. 7, a transition of the engine revolution speed is illustrated using the dotted line in a case where an operation of the operation lever 26A by the operator is temporarily stopped for a short time period while an ordinary auto-idling is being performed without performing the above engine revolution speed control process.

Referring to FIG. 7, the operation lever 26A is operated to conduct the work of the shovel up to a time t1. Then, at a time t1, the operator keeps the operation lever 26 at a neutral position to take a pause, and restarts the operation at a time t2 without separating the hand from the operation lever 26A.

In a case where the engine revolution speed control process according to this embodiment is not conducted, the ordinary auto idling function works. Therefore, the revolution speed of the engine 11 is set to be an idling revolution speed after the time t1. Therefore, the engine revolution speed abruptly decreases as indicated by the dotted line illustrated in FIG. 8. The operator starts the operation of the operation lever 26A again. Then, the idling running operation mode is canceled, the engine revolution speed is changed to increase and reaches a set revolution speed for the work at a time t3. In this case, the output of the engine 11 is smaller during a period between a time t2 and a time t3 than during the ordinary work. Therefore, the operation is insufficient relative to the operation quantity of the operation lever 26A. Said differently, the ordinary work cannot be done until the revolution speed of the engine 11 is recovered. Therefore, the operator may have an uncomfortable feeling or a feeling of dissatisfaction.

On the other hand, in a case where an engine revolution speed control process of this embodiment is performed, the revolution speed of the engine 11 is kept to be the revolution speed for the work as indicated by the solid line illustrated in FIG. 7. Said differently, because the operator's hand is not separated from the operation lever 26A on or after the time t1, the revolution speed of the engine 11 is kept to be the revolution speed for the work. Therefore, when the operation of the operation lever 26A is started to be operated at the time t2 again, the engine 11 can immediately output power corresponding to the revolution speed for the ordinary work. Thus, the operator feels no inconvenience.

In step S2, if the operation determining part 30*a* determines in step S2 that the hand of the operator is not included inside the predetermined area including the operation lever 26A (NO in step S2), then the process goes to step S4. In step S4, the revolution speed controlling part 30*b* of the controller 30 sets the revolution speed of the engine 11 to be the revolution speed for the idling running operation based on the determination in the operation determining part 30*a*. For example, if the revolution speed of the engine 11 is set to the revolution speed for the ordinary running operation, the revolution speed controlling part 30*b* sends a command to the ECU 74 so as to decrease the revolution speed of the engine 11 to the idling speed.

Said differently, in a case where the hand of the operator is not included inside the predetermined area including the operation lever 26A, the controller 30 determines that the operator does not operate or is not intended to operate the operation lever 26A and causes the revolution speed of the engine 11 to be the idling revolution speed. This corresponds to a so-called auto-idling function. With this, for example, a case where the operator does not operate the operation lever 26A and does not conduct the work, the revolution speed of the engine 11 can be automatically decreased to the idling revolution speed so as to decrease a fuel consumption of the engine 11.

After the process of step S4, the operation determining part 30*a* captures the image information from the camera C1 again (step S5). The image information captured here is preferably image information for checking a motion of the hand of the operator. The image information preferably includes multiple images captured at a predetermined short interval.

The operation determining part 30*a* determines whether the hand of the operator is close to the operation lever 26A (or a predetermined area including the operation lever 26A) based on the captured image information (step S6). More specifically, the operation determining part 30*a* recognizes the position of the hand whose image is captured at an earlier time and the position of the hand whose image is captured at a later time from among multiple images captured at a time interval. For example, in a case where the position of the hand whose image is captured at the earlier time is included in a first area (an area inside a circle A2 indicated by a dotted line in FIG. 5), and the position of the hand whose image is captured at the later time is included in a second area (an area inside a circle A1 indicated by a dotted line in FIG. 5) smaller than the first area, it is determined that the hand of the operator is approaching the operation lever 26A (the hand is moving to the operation lever). Alternatively, the operation determining part 30*a* determines that a distance between the hand whose image is captured at the later time and the operation lever 26A is shorter than a distance between the hand whose image is captured at the earlier time and the operation lever 26A, it is determined that the hand of the operator is approaching the operation lever 26A (the hand is moving to the operation lever). The circle A1 has a diameter of about 50 mm, and the circle A2 has a diameter of about 100 mm, for example. Further, the first area A2 may be omitted.

In step S6, if the operation determining part 30*a* determines that the hand of the operator is approaching the operation lever 26A (or the predetermined area including the operation lever 26A)(YES of step S6), the process goes to step S3. In step S3, the revolution speed controlling part 30*b* of the controller 30 sets the revolution speed of the engine 11 to be the revolution speed for the ordinary running operation based on the determination in the operation determining part 30*a*. In this case, because the revolution speed of the engine 11 is set to be the idling revolution speed, the revolution speed controlling part 30*b* sends a command to the ECU 74 so as to increase the revolution speed of the engine 11 to the revolution speed of the engine 11 for the work.

In step S6, if the operation determining part 30*a* determines that the hand of the operator is not approaching the operation lever 26A (or the predetermined area including the operation lever 26A)(NO of step S6), the process goes back to step S5, and the processes of steps S5 and S6 are repeated.

Figure 8:
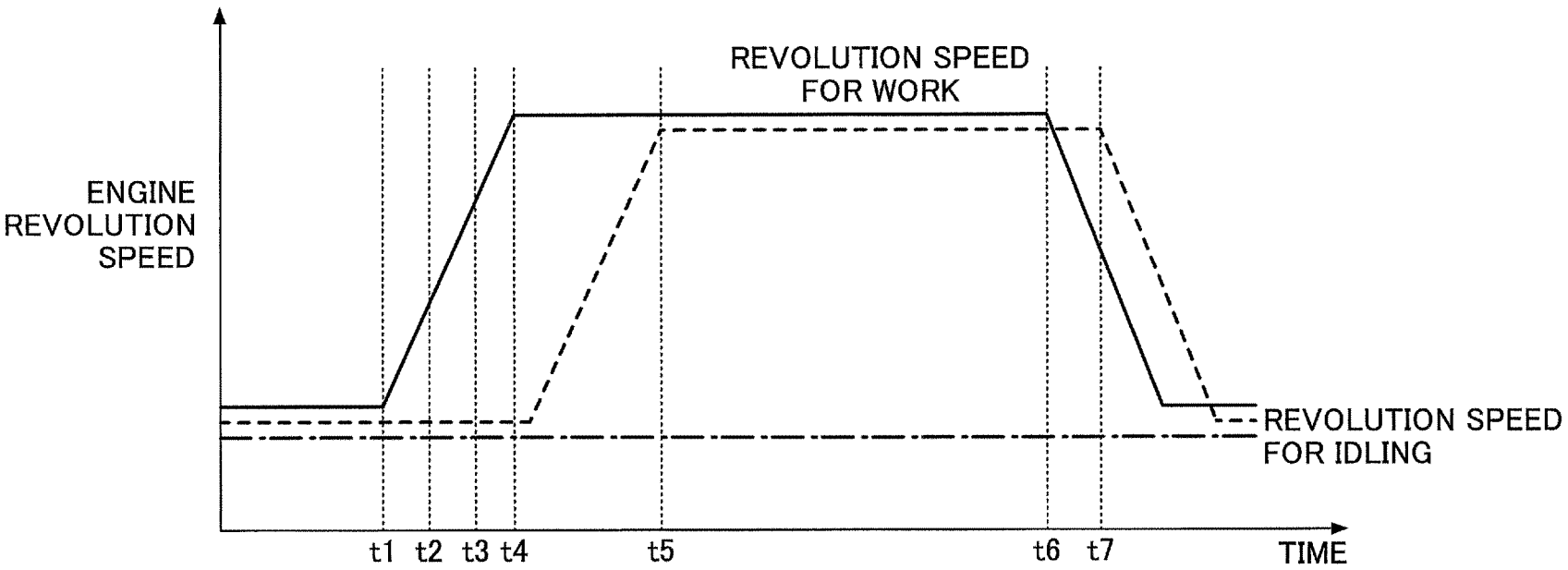
FIG. 8 is a time chart illustrating a change in the engine revolution speed on and after the operation lever is operated and until the operation ends.

FIG. 8 is a time chart illustrating a change in the engine revolution speed in a case where the above engine revolution speed control process is done. Referring to FIG. 8, a transition of the engine revolution speed is illustrated using the solid line between a start of an operation of the operation lever 26A by the operator and an end of the operation while the above engine revolution speed control process is performed. Referring to FIG. 8, a transition of the engine revolution speed is illustrated using the dotted line between the start of the operation of the operation lever 26A by the operator and the end of the operation while an ordinary auto-idling is being performed without performing the above engine revolution speed control process.

Referring to FIG. 8, the operation lever 26A is not operated until the time t1, and the revolution speed of the engine 11 is the idling revolution speed. The operator brings the hand closer to the operation lever 26A at the time t1, holds the operation lever 26A with the hand at the time t2, and starts an operation of the operation lever 26A.

In a case where the engine revolution speed control process of this embodiment is not performed, the ordinary auto idling function works, and a process of returning the revolution speed of the engine 11 to the revolution speed for the work after a time t4 when the operation of the operation lever 26A is detected after the time t3. Therefore, as indicated by the dotted line illustrated in FIG. 8, the engine revolution speed starts to increase after the time t4 and reaches the revolution speed for the work at the time t5. Accordingly, the worker cannot work using an ordinary power until the time t5.

On the other hand, in a case where the engine revolution speed control process of the above embodiment is performed, the processes of steps S5, S6, and S3 in this order are performed at the time t1 when the worker brings the hand to the operation lever 26A to set the revolution speed of the engine 11 to be the revolution speed for the work. Therefore, as indicated by the solid line illustrated in FIG. 8, the revolution speed of the engine 11 starts to increase at the time t1 when the worker does not start the operation of the operation lever 26A and returns to the revolution speed for the work at the time t4 far back of the time t5. As described, according to the engine revolution speed control process of this embodiment, the revolution speed of the engine 11 is rapidly increased at the time of starting the operation of the operation lever 26A. Therefore, the ordinary work can be immediately done.

Further, when the work is ceased, the worker separates the hand from the operation lever 26A immediately after returning the operation lever 26A to the neutral position at a time t6. In the case where the engine revolution speed control process is not performed, the operation lever 26A is in a neutral position at the time t6, this state continues until a time t7 after a predetermined time period from the time t6, and thereafter the engine revolution speed is controlled to decrease to the idling revolution speed. Therefore, the engine revolution speed starts to drop at the time t7 the predetermined time after the time t6 as indicated by the dotted line illustrated in FIG. 8 so as to be the idling revolution speed.

On the other hand, in a case where the engine revolution speed control process of this embodiment is performed, the idling revolution speed is immediately set at the time t6. Further, as indicated by the solid line illustrated in FIG. 8, the engine revolution speed starts to decrease from the time at the time t6 when the worker separates the hand from the operation lever 26A and becomes the idling revolution speed. Said differently, it is possible to rapidly transit to the idling running operation without waiting the determination that the neutral position continues the predetermined time after the predetermined time runs after the operation lever 26A becomes in the neutral position.

Although the engine revolution speed control process related to the operation of only the operation lever 26A has been described, an engine revolution speed control process similar to the above engine revolution speed control process is applicable to an operation to other operation components (the operation lever and the operation pedal).

For example, the above engine revolution speed control process may be applied to an operation of the operation lever 26B. Further, the engine revolution speed control process for the operation lever 26A and the engine revolution speed control process for the operation lever 26B may be simultaneously performed.

Further, the above engine revolution speed control process may be applied to one or both of the operation pedals 26C and 26D. In this case, an image of a foot of the operator is recognized and an existence of an operation is determined based on the positional relationship between the image of the foot and the pedals 26C and 26D.

Further, the above engine revolution speed control process may be applied to one or both of the operation levers 27E and 27F.

When the above engine revolution speed control process is applied to multiple operation components, multiple processing results are prevented from competing against each other. For example, in a case where it is determined that any one of the operation components is operated in the process related to the any one of the operation components, the determination related to the other operation components is ignored and the determination that the any one of the operation components is prioritized so as to be used to keep the revolution speed for the work.

According to the embodiment of the present invention, it is possible to previously determine whether the operation components are operated based on a captured image of the operation components to rapidly control the engine revolution speed.

All examples and conditional language recited herein are intended for pedagogical purposes to aid the reader in understanding the embodiments and the concepts contributed by the inventor to furthering the art, and are to be construed as being without limitation to such specifically recited examples and conditions, nor does the organization of such examples in the specification relate to a showing of superiority or inferiority of the embodiments. Although the shovel has been described in detail, it should be understood that the various changes, substitutions, and alterations could be made hereto without departing from the spirit and scope of the invention.

What is claimed is:

1. A shovel enabled to set an engine revolution speed to a plurality of revolution speeds, the plurality of revolution speeds including:

a revolution speed for a running operation, and a revolution speed for an idling running operation that is lower than the revolution speed for the running operation, the shovel comprising:

a cabin;

an engine provided as a driving source of the shovel;

an operating part configured to be driven by a driving force of the engine;

an operation component configured to operate the operating part;

a detecting device installed at a first position inside the cabin so as to detect a second position of a movable portion of an operator and a third position of the operation component, the first position of the detecting device being apart from the third position of the operation component;

an operation determining part configured to determine a positional relationship between the second position of the movable portion of the operator and the third position of the operation component, the positional relationship being determined during the movable portion of the operator is out of contact with the operation component; and a control part configured to set the engine revolution speed of the engine based on the determined positional relationship in which the movable portion of the operator is out of contact with the operation component, wherein the engine is kept revolving even when the positional relationship between the second position and the third position is changed.

2. The shovel according to claim 1, wherein when the operation determining part determines that the movable portion of the operator is in the second position contacting the operation component, the control part continuously sets the engine revolution speed to the revolution speed for the running operation.

3. The shovel according to claim 1, wherein when the operation determining part determines that the movable portion of the operator is moving toward the operation component in a state where the engine revolution speed is set to the revolution speed for the idling running operation, the control part sets the engine revolution speed to the revolution speed for the running operation.

4. The shovel according to claim 1, wherein when the operation determining part determines that the movable portion of the operator does not touch the operation component, the control part sets the engine revolution speed to the revolution speed for the idling running operation.

5. The shovel according to claim 1, wherein the operation component is an operation lever operable by a hand of the operator.

6. The shovel according to claim 1, wherein the operation component is an operation pedal operable by a foot of the operator.

7. The shovel according to claim 1, wherein the detecting device is an image capturing device configured to capture an image of the operation component and a vicinity of the operation component, and wherein the operation determining part determines whether the operation component is operated using the captured image captured by the image capturing device.

* * * * *